US007972075B2

(12) United States Patent
Tajima

(10) Patent No.: US 7,972,075 B2
(45) Date of Patent: Jul. 5, 2011

(54) APPLICATOR

(75) Inventor: Yoshiaki Tajima, Tokyo (JP)

(73) Assignee: Tokiwa Corporation, Gifu (JP)

( * ) Notice: Subject to any disclaimer, the term of this patent is extended or adjusted under 35 U.S.C. 154(b) by 379 days.

(21) Appl. No.: 11/659,969

(22) PCT Filed: Aug. 29, 2005

(86) PCT No.: PCT/JP2005/016152

§ 371 (c)(1),
(2), (4) Date: Feb. 12, 2007

(87) PCT Pub. No.: WO2006/025537

PCT Pub. Date: Mar. 9, 2006

(65) Prior Publication Data

US 2007/0251542 A1 Nov. 1, 2007

(30) Foreign Application Priority Data

Sep. 2, 2004 (JP) ..... 2004-255548

(51) Int. Cl.
*A47L 13/22* (2006.01)

(52) U.S. Cl. ..... 401/286; 401/265

(58) Field of Classification Search ..... 401/139, 401/261, 265, 266, 282, 286; 132/320
See application file for complete search history.

(56) References Cited

U.S. PATENT DOCUMENTS

| | | | | | |
|---|---|---|---|---|---|
| 3,945,869 | A | * | 3/1976 | Miller et al. | 156/180 |
| 4,940,351 | A | * | 7/1990 | Konose | 401/278 |
| 5,454,660 | A | * | 10/1995 | Sakurai et al. | 401/266 |
| 6,155,735 | A | * | 12/2000 | Nakajima | 401/172 |

FOREIGN PATENT DOCUMENTS

| | | |
|---|---|---|
| JP | 06-022816 | 2/1994 |
| JP | 2517866 | 9/1996 |

* cited by examiner

*Primary Examiner* — David J Walczak
(74) *Attorney, Agent, or Firm* — Bacon & Thomas, PLLC

(57) ABSTRACT

To provide an applicator in which an application core does not become shaky or unstable even if force in a lateral direction is applied to an application portion of the application core during use, an applicator is provided with a container (1) having an accommodation portion (101) to accommodate a liquid material (10), and an application core (2) supported by a leading end inner portion of the container (1) from an outside and having a communication hole (23) communicated from an inside of the accommodation portion (101) and extending toward a leading end side, the container (1) has a guide tube (102) guiding the liquid material (10) toward a leading end side from an inside of the accommodation portion (101) to be inserted fitly to the communication hole (23) from a rear side, and the application core (2) is supported by the guide tube (102) from a rear side.

7 Claims, 7 Drawing Sheets

APPLICATOR

This is a nationalization of the International Patent Application No. PCT/JP2005/016152 filed Aug. 29, 2005 and published in Japanese.

TECHNICAL FIELD

The present invention relates to an applicator used for a container with application member by which a user can appropriately extrude a liquid material, for example, an internal cosmetic.

BACKGROUND ART

As a conventional applicator, for example, there is disclosed a structure provided with a container having an accommodation portion, for example, in which a liquid material is accommodated, and an application core supported by a leading end portion of the container from an outer side and having a communication hole communicated from an inner side of the accommodation portion and extending toward a leading end side (for example, refer to Japanese Utility Model No. 2517866).

DISCLOSURE OF THE INVENTION

Problem to be Solved by the Invention

In this case, in the conventional applicator, since the application core is attached to the container by the technical means that an outer portion of the application core is supported only by a leading end inner portion of the container, a force in a lateral direction generated in accordance with use is applied to the application portion corresponding to the leading end portion of the application core in the conventional applicator, whereby the application core is shaky and becomes unstable. Accordingly, it is requested to securely avoid the matter mentioned above, in the conventional applicator.

Accordingly, an object of the present invention is to provide an applicator which can effectively avoid the matter that an application core is shaky and becomes unstable even if a force in a lateral direction in accordance with use is applied to an application portion of the application core, thereby achieving an improvement of a durability of a product with an application core and a spread of the product to a market.

Means for Solving the Problem

In order to achieve the object mentioned above, in accordance with the present invention, there is provided an applicator comprising:

a container having an accommodation portion in which a liquid material is accommodated; and an application core supported by a leading end inner portion of the container from an outer side and having a communication hole communicated from an inner side of the accommodation portion and extending toward a leading end side, wherein the container has a guide tube extended toward a leading end side from a rear side so as to be inserted and fitted to the communication hole and provided for guiding the liquid material, and the application core is supported by the guide tube from a rear side.

In accordance with the applicator mentioned above, since the application core is not only supported by the leading end inner portion of the container from the outer side thereof, but also supported by the guide tube extended from the rear side thereof, it is possible to effectively avoid the matter that the application core is shaky and becomes unstable even if the force in the lateral direction in accordance with use is applied to the application portion of the application core, and it is possible to achieve an improvement of a durability of a product with application core and a spread of the product to a market as a result.

In the technical means mentioned above, if the application core is constituted by a permeable application core in which the liquid material is supplied to the application portion corresponding to the leading end portion through a movement of the liquid material in the communication hole and the permeation of the liquid material permeated from the inner side of the communication hole in the application core, in the sight of adapting the application core to a viscosity of the liquid material by adjusting a length of the guide tube fitted and inserted into the communication hole without adjusting an inner diameter of the communication hole, and intending to widen a viscosity range of the liquid material which the application core having the communication hole having the same inner diameter can apply to, it is preferable to regulate the permeation of the liquid material to the application core from the inner side of the communication hole by the guide tube fitted and inserted to the communication hole.

In this case, in the sight of having a method of regulating a pressure extruding the liquid material within the cylinder as a technical means for adapting the application core to the viscosity of the liquid material together, and intending to further widen the viscosity range of the liquid material which the application core having the communication hole having the same inner diameter can apply to, it is preferable that the container is provided with a cylinder in which an accommodation portion is formed as an inner portion, a piston slidably arranged within the cylinder along an axial direction, and an extrusion mechanism extruding the liquid material within the cylinder via the piston.

Effect of the Invention

In accordance with the applicator on the basis of the present invention, it is possible to effectively avoid the matter that the application core is shaky and becomes unstable even if the force in the lateral direction in accordance with use is applied to the application portion of the application core, so that it is possible to achieve an improvement of a durability of the product with the application core and a spread of the product to a market.

EXPLANATION OF REFERENCE NUMERALS

Figure 1:
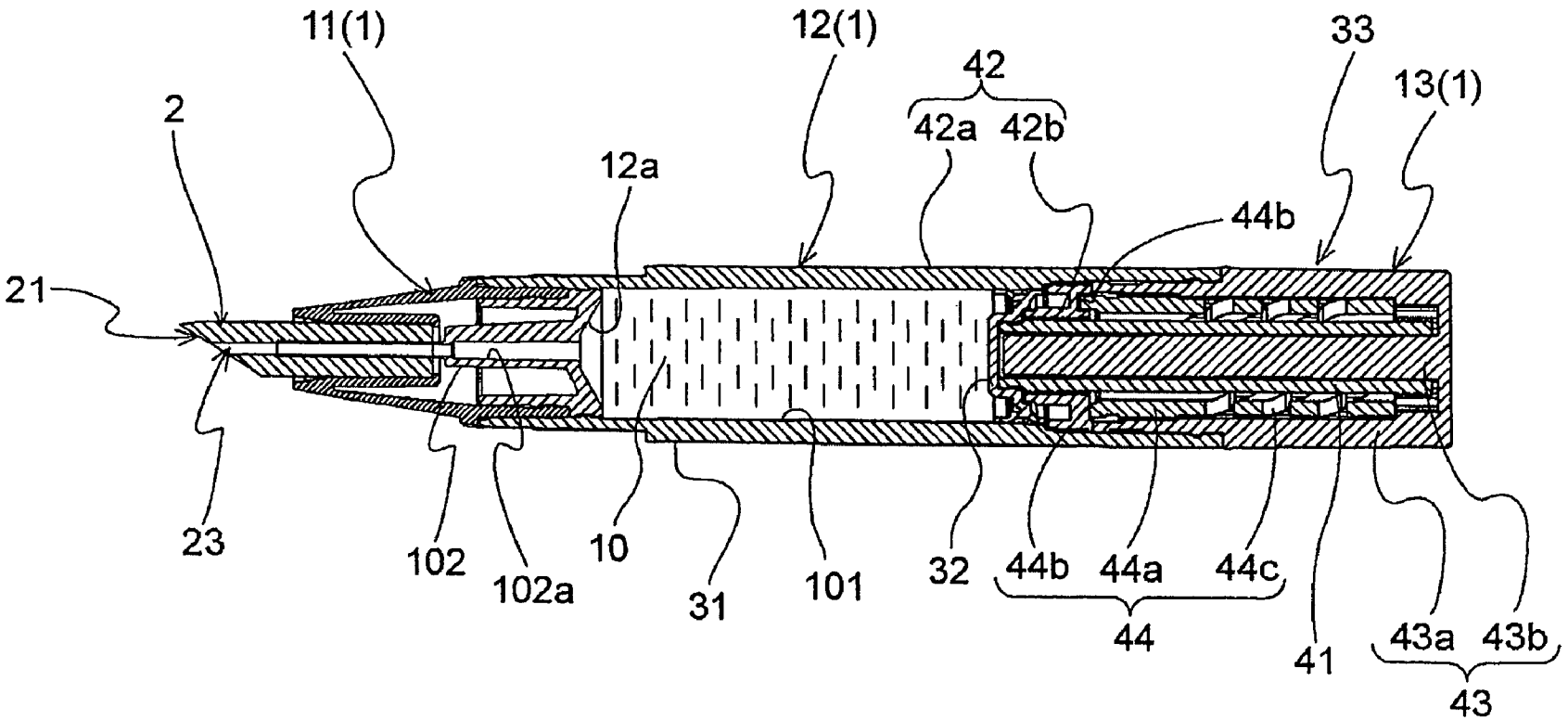
FIG. 1 is a cross sectional view showing an applicator in accordance with an embodiment of the present invention.

1 liquid cosmetic extrusion container
2 felt chip

11 sleeve
11*a* protrusions
12 main body
13 operation body
21 application portion
22 permeation path
23 communication hole
31 cylinder
32 piston
33 extrusion mechanism
41 movable body
42 main body
42*a* main body tube
42*b* tubular body
43 operation body
43*a* operation tube
43*b* shaft body
44 ratchet
44*a* ratchet tube
44*b* pair of ratchet gear
44*c* ratchet spring
101 accommodation portion
102 guide tube
102*a* liquid path

BEST MODE FOR CARRYING OUT THE INVENTION

A description will be in detail given below of an embodiment in accordance with the present invention with reference to the accompanying drawings.

Figure 2:
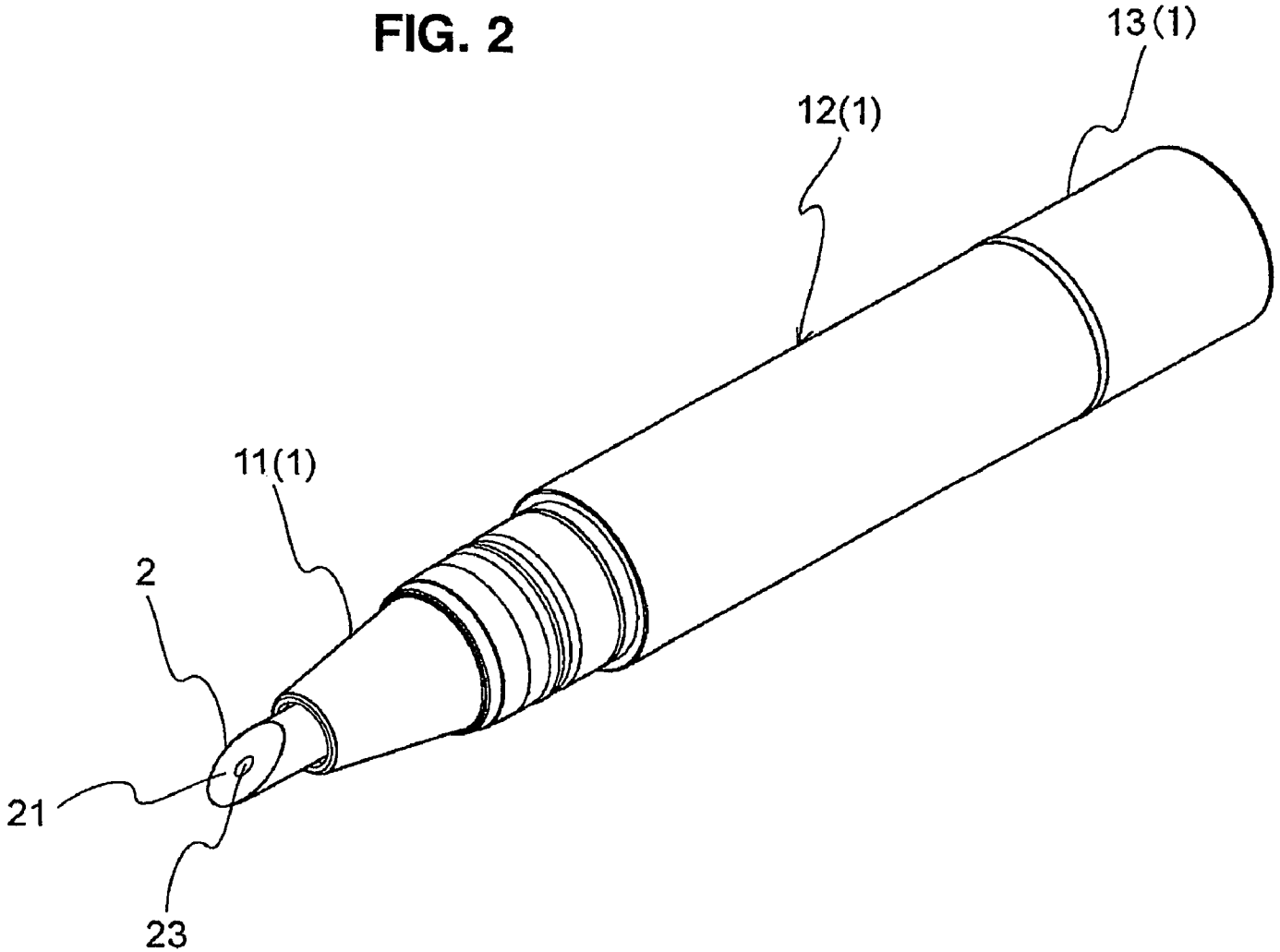
FIG. 2 is a perspective view showing an outer appearance of the applicator.
Figure 3:
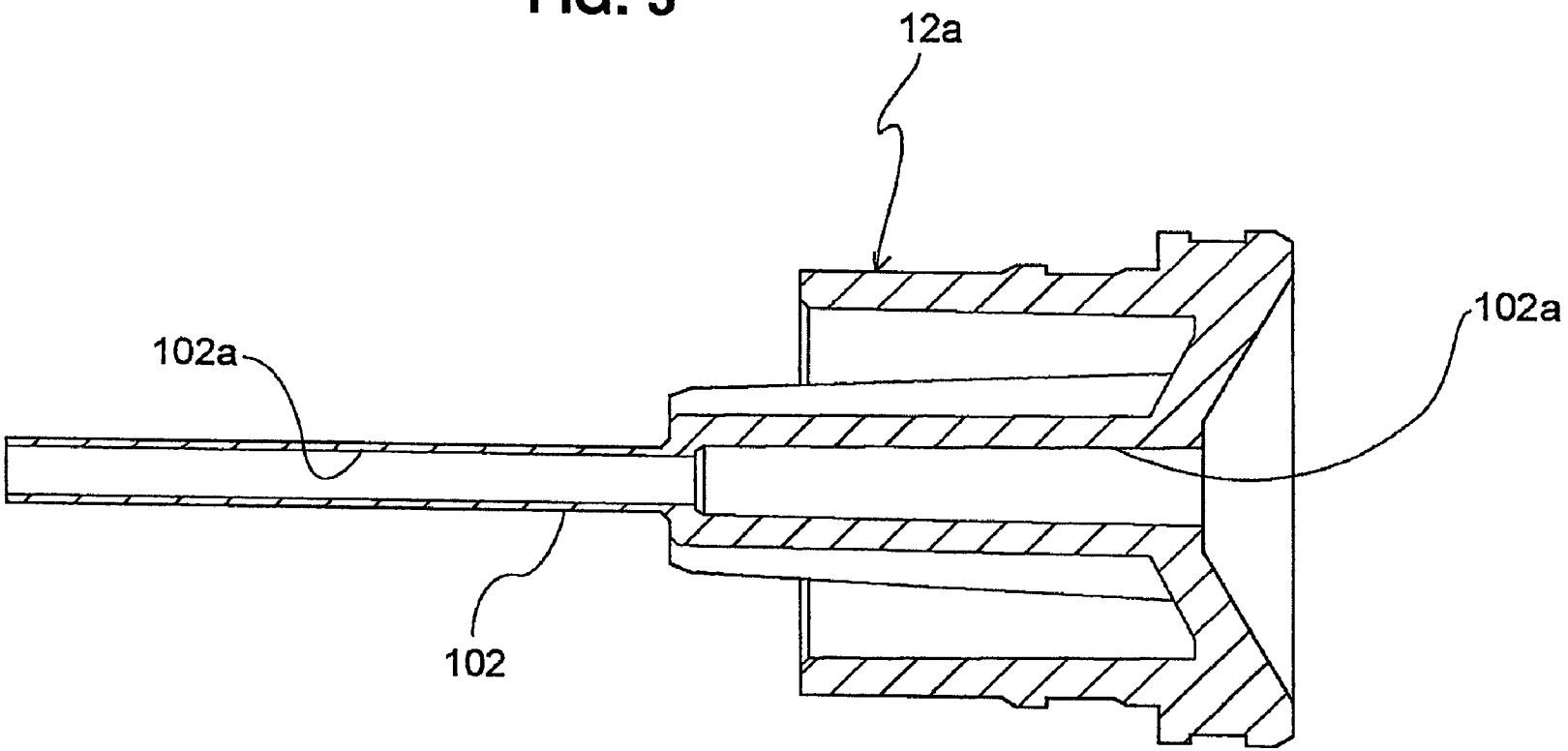
FIG. 3 is a longitudinal sectional view showing a pipe holder in the applicator.
Figure 4:
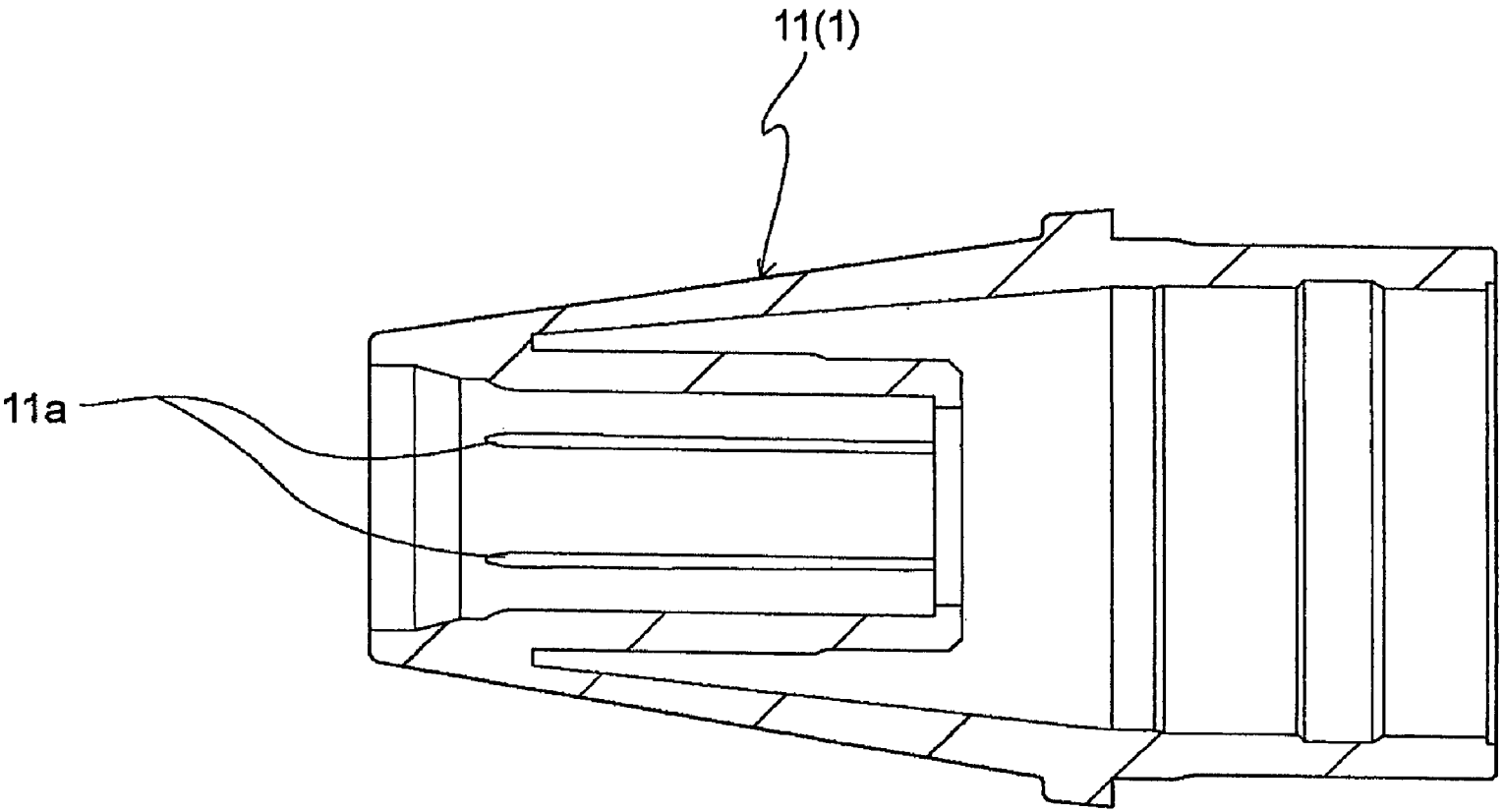
FIG. 4 is a longitudinal sectional view showing a sleeve in the applicator.
Figure 5A:
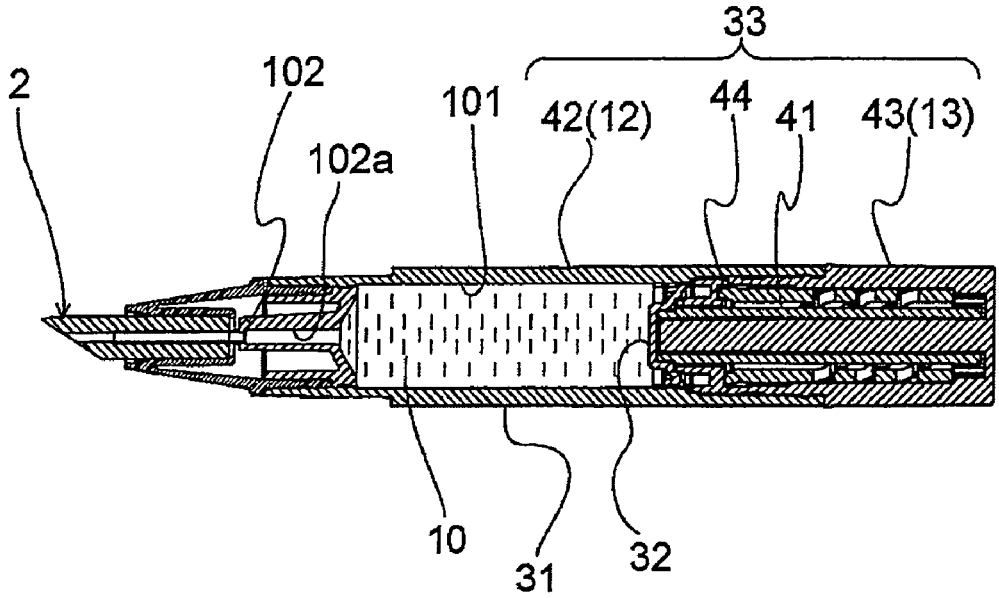
FIG. 5 is a longitudinal sectional view for explaining an operation of the applicator.
Figure 5B:
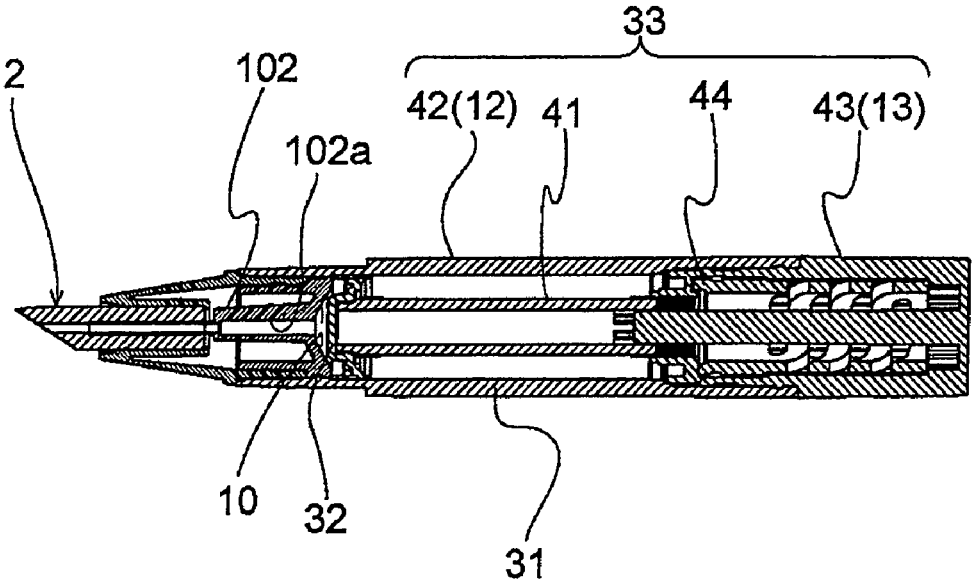
Figure 6:
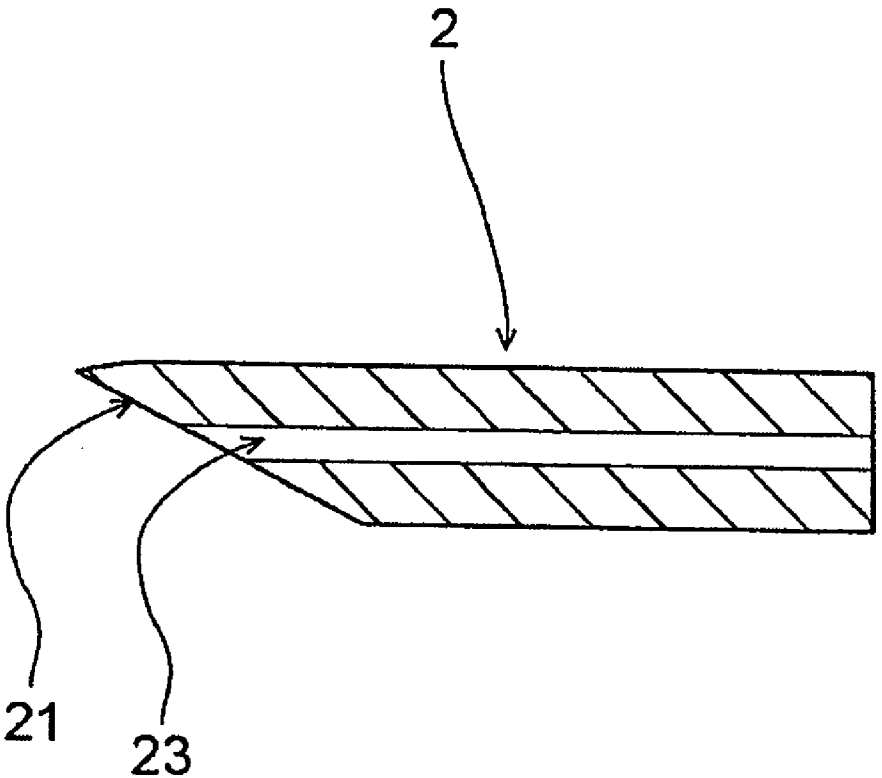
FIG. 6 is a longitudinal sectional view showing a felt chip in the applicator.
Figure 7:
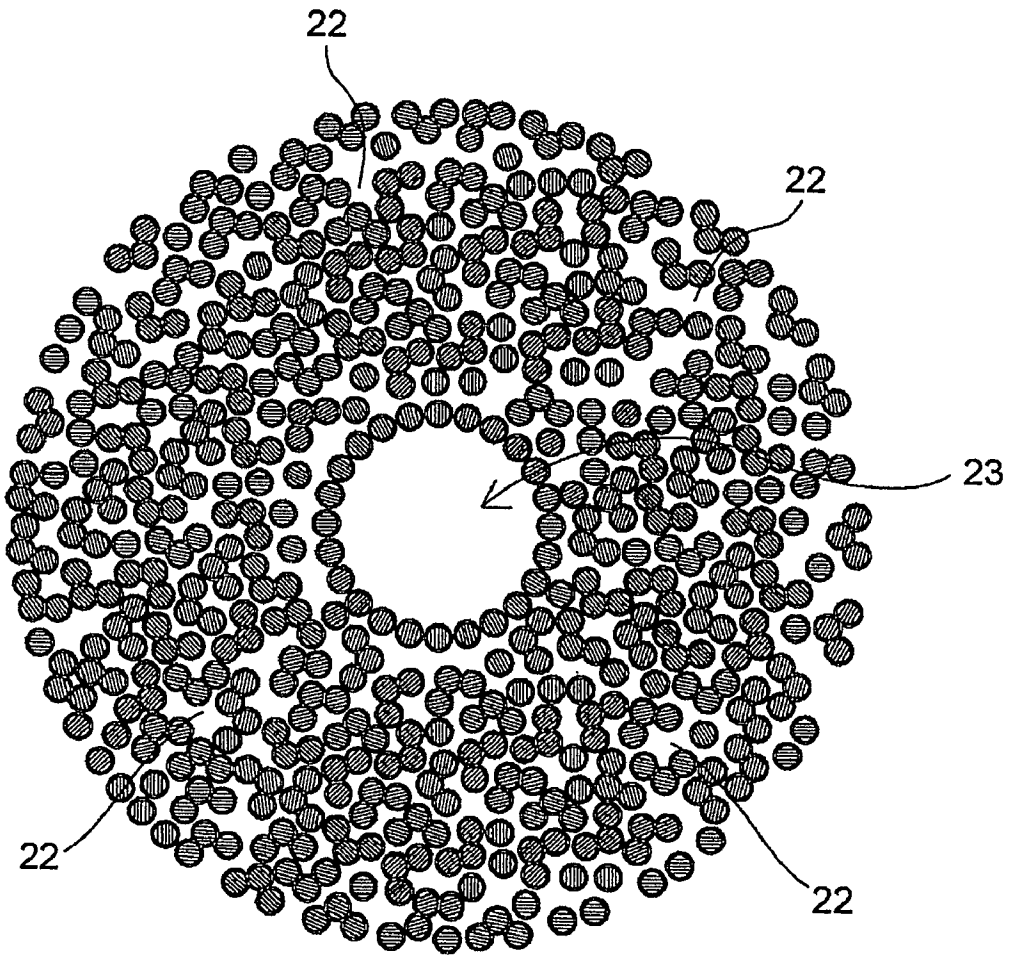
FIG. 7 is a cross sectional view showing the felt chip.

FIG. 1 is a cross sectional view showing an applicator in accordance with an embodiment of the present invention, FIG. 2 is a perspective view showing an outer appearance of the applicator, FIG. 3 is a longitudinal sectional view showing a pipe holder in the applicator, FIG. 4 is a longitudinal sectional view showing a sleeve in the applicator, FIG. 5 is a longitudinal sectional view for explaining an operation of the applicator, FIG. 6 is a longitudinal sectional view showing a felt chip in the applicator, and FIG. 7 is a cross sectional view showing the felt chip.

In the present embodiment, the applicator is structured such as to be provided with a liquid cosmetic extrusion container 1 by which a user can appropriately extrude a nail cosmetic liquid 10 corresponding to an internal liquid material so as to apply, and a felt chip 2 corresponding to an application core for applying the nail cosmetic liquid 10 extruded from an inner side of the liquid cosmetic extrusion container 1, as shown in FIG. 1.

A description will be further in detail given below of each of these constituting elements.

(1) Liquid Cosmetic Extrusion Container 1

The liquid cosmetic extrusion container 1 is structured, as shown in FIGS. 1 and 2, such as to be provided with a tapered cylindrical sleeve 11 supporting the felt chip 2 from an outer side by a leading end inner portion, a cylindrical main body 12 fitted and attached to a rear portion of the sleeve 11, and a cylindrical operation body 13 connected to a rear portion of the main body 12 so as to be rotatable around an axis and having a bottom in a rear portion.

In the present embodiment, as shown in FIG. 1, the liquid cosmetic extrusion container 1 is structured such as to have an accommodation portion 101 in which the nail cosmetic liquid 10 is accommodated.

In particular, the accommodation portion 101 is formed by a rear side portion of a pipe holder 12*a* mentioned below, the main body 12 connected to an outer portion of the pipe holder 12*a* in a watertight manner, thereby holding an outer portion of the sleeve 11, and a leading end side portion of a piston 32 mentioned below, as shown in FIG. 1.

Further, the liquid cosmetic extrusion container 1 has a guide tube 102 forming a liquid path 102*a* communicated with an inner side of the accommodation portion 101 and extending along an axial direction toward a leading end side in an inner side of the liquid cosmetic extrusion container 1, as shown in FIG. 1.

The guide tube 102 is structured, as shown in FIG. 1, such as to be extended toward a leading end side from a rear side and be fitted and inserted to a communication hole 23 from a rear side. In other words, the guide tube 102 is fitted and inserted to a midportion within the communication hole 23 from a rear end portion of the felt chip 2, thereby serving to support the felt chip 2 from a rear side.

In particular, the guide tube 102 is structured, as shown in FIGS. 1 and 3, such as to be integrally formed with the pipe holder 12*a* in an inner side of the pipe holder 12*a* in which an outer portion is fitted and attached to an inner portion of the main body 12.

The liquid cosmetic extrusion container 1 is required to have the guide tube 102 supporting the felt chip 2 from the rear side, because the applicator is structured as an applicator which can effectively avoid a matter that the felt chip 2 is shaky and becomes unstable even if a force in a lateral direction in accordance with use is applied to the leading end portion of the felt chip 2, not only by supporting the felt chip 2 by the leading end inner portion of the container from the outer side, but also supporting the felt chip 2 by the guide tube 102 of the container from the rear side. Accordingly, as far as it can serve as mentioned above, it is possible to employ a container having a guide tube provided toward the leading end side from the inner side of the main body 12, and integrally formed with the main body 12 and the other various containers, in place of the liquid cosmetic extrusion container 1 in which the pipe holder 12*a* integrally forming the guide tube 102 is attached within the main body 12, in the present invention.

In this case, the guide tube 102 also serves to regulate a permeation of the nail cosmetic liquid 10 into the felt chip 2 from the inner side of the communication hole 23 (refer to FIG. 1). In other words, the guide tube 102 is structured such that the nail cosmetic liquid 10 hardly flows into a permeation path 22 within the communication hole 23 to which the guide tube 102 is fitted and inserted (refer to FIGS. 1 and 7).

The liquid cosmetic extrusion container 1 is required to have the guide tube 102 serving as mentioned above, because the applicator is structured as an applicator which can significantly widen a viscosity range of the nail cosmetic liquid at which the same felt chip can apply, by employing a means for regulating a length of the guide tube 102 fitted and inserted to the communication hole 23 without employing a means for regulating an inner diameter of the communication hole 23, as a technical means for adapting the felt chip 2 to the viscosity of the nail cosmetic liquid 10. Accordingly, it is possible to employ a tube type container, a bottle type container or the other various containers in place of the liquid cosmetic extrusion container 1 in the present invention, as far as serving as mentioned above.

In this case, as shown in FIG. 4, the sleeve 11 is provided with a plurality of protrusions 11*a* protruding toward an inner side from an inner portion of the sleeve 11 and extending along an axial direction toward a tapered leading end portion along a peripheral direction, and the felt chip 2 is supported from an outer side by the protrusions 11*a* of the sleeve 11.

In the present embodiment, the liquid cosmetic extrusion container 1 is provided with a cylinder 31 in which an accommodation portion 101 thereof is formed as an inner portion, a piston 32 provided within the cylinder 31 so as to be slidable along an axial direction, and an extrusion mechanism 33 extruding the nail cosmetic liquid 10 within the cylinder 31 via the piston 32, as shown in FIG. 1.

In accordance with the liquid cosmetic extrusion container 1 mentioned above, it is possible to have a method of regulating a pressure of extruding the nail cosmetic liquid 10 within the cylinder 31, as well as a method of regulating the length of the portion of the communication hole 23 to which the guide tube 102 is not fitted and inserted, together, as a technical means for optimization to the viscosity of the nail cosmetic liquid 10. As a result, it is possible to further widen the viscosity range of the nail cosmetic liquid which the same felt chip can apply to.

In particular, the extrusion mechanism 33 is provided with a cylindrical movable body 41 in which a male thread is formed in an outer periphery, a tubular main body 42 in which a female thread engaged with the male thread of the movable body 41 is formed in a midportion of an inner periphery, a tubular operation body 43 coupled so as to be rotatable around an axis with respect to the main body 42 and having a shaft body 43*b* provided so as to protrude toward a leading end side from a bottom in a rear end and to which the movable body 41 engaged with the female thread is fitted so as to be non-rotatable and movable in a length direction, and a ratchet 44 for regulating the movement of the movable body 41 in a rearward direction, as shown in FIG. 1, and is structured such that the movable body 41 can be fed out gradually by relatively rotating the main body 42 and the operation body 43.

In this case, the male thread includes a group of projections intermittently arranged on an outer side surface or a group of projections spirally and intermittently arranged on an outer side surface and serving the same function as a thread ridge. Further, the female thread includes a group of projections intermittently arranged in an inner side surface or a group of projections spirally and intermittently arranged in an inner side surface and serving the same function as the thread ridge.

In particular, the main body 42 is constituted by a main body tube 42*a* connected so as to be rotatable around an axis by the operation tube 43*a*, and a tubular body 42*b* in which a female thread is provided in an inner portion fitted and attached to the midportion within the main body tube 42*a*, as shown in FIG. 1.

Further, the operation body 43 is constituted by an operation tube 43*a* connected to a rear portion of the main body tube 42*a* so as to be rotatable around an axis, and a shaft body 43*b* inserted into the movable body 41 from a rear side so as to be non-rotatable and slidable in a length direction, as shown in FIG. 1.

Further, the ratchet 44 is provided with a ratchet tube 44*a* assembled within the operation tube 43*a* so as to be non-rotatable, a pair of ratchet gears 44*b* constituted by a ratchet gear provided in the tubular body 42*b* and a ratchet gear provided in the ratchet tube 44*a*, and a ratchet spring 44*c* pinched between the ratchet tube 44*a* and an inner portion of the operation tube 43*a* and energizing the ratchet tube 44*a* to the tubular body 42*b*, as shown in FIG. 1.

On the other hand, the piston 32 is formed as a disc shape, is coupled to a leading end portion of the movable body 41, and is inserted and fitted into the main body tube 42*a* in a watertight manner, thereby capable of sliding in the length direction (refer to FIG. 1).

Accordingly, in the piston 32 mentioned above, the piston 32 can be gradually extruded together with the movable body 41 which is gradually delivered by a relative rotation between the main body 42 and the operation body 43 executed by a user, whereby it is possible to extrude the nail cosmetic liquid 10 from the inner side of the accommodation portion 101 toward an inner side of the liquid path 102*a* of the guide tube 102 (refer to FIG. 5).

(2) Felt Chip 2

The felt chip 2 is structured such as to be supported from an outer side by the leading end inner portion of the liquid cosmetic extrusion container 1, thereby being attached to the liquid cosmetic extrusion container 1, as shown in FIG. 1.

In particular, the felt chip 2 has the communication hole 23 communicated from the inner side of the accommodation portion 101 and extending toward a leading end side, as shown in FIG. 1.

In this case, as shown in FIG. 1, the guide tube 102 extended out from the inner portion of the liquid cosmetic extrusion container 1 toward the leading end side is fitted and inserted into the communication hole 23 of the felt chip 2 from a rear side, and the felt chip 2 is supported from a rear side by the guide tube 102.

The felt chip 2 is required to be supported from the rear side by the guide tube 102 of the liquid cosmetic extrusion container 1, because the applicator is structured as an applicator which can effectively avoid the matter that the felt chip 2 is shaky and becomes unstable even if the force in the lateral direction in accordance with use is applied to the application portion 2 of the felt chip 2, not only by supporting the felt chip 2 from the outer side by the leading end inner portion of the container but also by supporting the felt chip 2 from the rear side by the guide tube 102. Accordingly, it is possible to employ the other application core having no permeability than an application core made of a fiber or a felt or similar porous or capillaceous materials, in place of the felt chip 2 in the present invention, as far as serving as mentioned above.

In particular, the felt chip 2 has an application portion 21 for applying the nail cosmetic liquid 10, and a lot of permeation paths 22 supplying the nail cosmetic liquid 10 from the rear end portion to the application portion 21 on the basis of a permeation and constituted by micro gaps, as shown in FIGS. 1, 6 and 7.

In this case, the felt chip 2 may be appropriately selected from materials which can achieve the function in the present invention, in addition to known felt materials such as a chemical fiber felt, a heat resisting fiber felt, a needle felt, a resin finish felt, a molded felt and the like, in addition to a felt made of wool.

In particular, the felt chip 2 extends along the axial direction from the rear end portion toward the leading end side, and has the communication hole 23 holding the nail cosmetic liquid 10 in the inner side thereof and supplying the nail cosmetic liquid 10 within the communication hole 23 into the permeation path 22 from the midportion thereof, as shown in these figures. Accordingly, the felt chip 2 is structured such as to have a permeability which supplies the nail cosmetic liquid 10 to the application portion 12 corresponding to the leading end portion thereof through the movement of the nail cosmetic liquid 10 in the communication hole 23 and the permeation of the nail cosmetic liquid 10 permeated from the inner side of the communication hole 23 in the felt chip 2.

In this case, the permeation of the nail cosmetic liquid 10 into the felt chip 2 from the inner side of the communication hole 23 is regulated by the guide tube 102 fitted into the communication hole 23 (refer to FIG. 1). Accordingly, the felt chip 2 is structured such that a fitly inserting section fitly inserted by the guide tube 102 is formed from the rear end position within the communication hole 23 to the midposition, and the inflow of the nail cosmetic liquid 10 from the inner side of the communication hole 23 to the inner side of the permeation path 22 in the fitting and inserting section is regulated (refer to FIG. 1).

In other words, the felt chip 2 mentioned above has the communication hole 23 serving to flow the nail cosmetic liquid 10 held in the inner side into the permeation path 22 from the midportion thereof, however, is structured such that the guide tube 102 is fitly inserted to the midportion within the communication hole 23, whereby the inflow of the nail cosmetic liquid into the permeation path 22 is stopped within the communication hole 23 to which the guide tube 102 is fitly inserted.

The communication hole 23 of the felt chip 2 is required to be structured such that the guide tube 102 is fitly inserted to the midportion thereof, because the applicator is structured as an applicator which can significantly widen the viscosity range of the nail cosmetic liquid which the same felt chip can apply, by employing the means for regulating the length of the guide tube 102 fitly inserted into the communication hole 23 without employing the means for regulating the inner diameter of the communication hole 23, as the technical means for adapting the felt chip 2 to the viscosity of the nail cosmetic liquid 10. Accordingly, as far as serving as mentioned above, it is possible to employ the application core having the permeability and made of the fiber or felt or the similar porous or capillaceous material thereto, in place of the felt chip 2 in the present embodiment.

As mentioned above, in accordance with the applicator in the present embodiment, since the felt chip 2 is not only supported by the leading end inner portion of the liquid cosmetic extrusion container 1 from the outer side thereof, but also supported by the guide tube 102 extended from the rear side thereof, it is possible to effectively avoid the matter that the felt chip 2 is shaky and becomes unstable even if the force in the lateral direction in accordance with use is applied to the application portion 21 of the felt chip 2, and it is possible to achieve an improvement of a durability of the product with the application core, and a spread of the product to a market as a result.

As mentioned above, the description is given of the present embodiment which is applied to the nail cosmetic liquid among the cosmetics, however, the present invention is not limited to the embodiment. The present invention may be applied, for example, to a concealer, an eye shadow and the other cosmetic liquid. Further, the present invention can be widely applied to a writing ink, a liquid material serving as a medical and pharmaceutical product and the other articles, without being limited to the cosmetics.

What is claimed is:

1. An applicator comprising:

a container having an accommodation portion in which a liquid material is accommodated; and an application core supported by a leading end inner portion of the container and having a communication hole in fluid communication with the accommodation portion and extending toward a leading end side, said container including:

a cylindrical main body having said accommodation portion;

a tapered cylindrical sleeve secured in a leading end of said cylindrical main body and having a plurality of protrusions protruding toward an inner side from an inner portion of said cylindrical sleeve and extending along an axial direction toward a tapered leading end portion along a peripheral direction; and a pipe holder secured in said cylindrical main body at a rear side of said cylindrical sleeve and having a guide tube integrated with said pipe holder and communicated with said accommodation portion and extending into said cylindrical sleeve;

said application core being fitted in said cylindrical sleeve and said guide tube of said pipe holder being inserted into said communication hole in said application core;

said application core being supported at an outside by said cylindrical sleeve and at an inside by said guide tube, said application core being supported through a rear side by said guide tube and at a rear side by said cylindrical sleeve.

2. An applicator as claimed in claim 1, wherein said application core is made of a porous material.

3. An applicator as claimed in claim 1, wherein said container is further provided with a piston slidably arranged within an accommodation portion of said cylindrical main body along an axial direction, and an extrusion mechanism extruding the liquid material within said accommodation portion via the piston.

4. An applicator as claimed in claim 1, wherein said liquid material is nail polish.

5. An applicator as claimed in claim 1, wherein said container is in the shape of a tube or a bottle.

6. An applicator as claimed in claim 1, wherein a plurality of permeation paths are within the communication hole.

7. An applicator as claimed in claim 6, wherein said plurality of permeation paths are micro gaps.

* * * * *